US012449177B2

(12) United States Patent
Hu et al.

(10) Patent No.: US 12,449,177 B2
(45) Date of Patent: Oct. 21, 2025

(54) METHODS FOR OPERATING DOMESTIC APPLIANCES INCLUDING MUNICIPAL WATER SUPPLIES

(71) Applicant: Haier US Appliance Solutions, Inc., Wilmington, DE (US)

(72) Inventors: Haitian Hu, Louisville, KY (US); Hairong Li, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 28 days.

(21) Appl. No.: 18/421,631

(22) Filed: Jan. 24, 2024

(65) Prior Publication Data

US 2025/0237422 A1 Jul. 24, 2025

(51) Int. Cl.
*F25C 1/25* (2018.01)

(52) U.S. Cl.
CPC ..... *F25C 1/25* (2018.01); *F25C 2400/14* (2013.01); *F25C 2600/04* (2013.01)

(58) Field of Classification Search
CPC .... F25C 1/25; F25C 2400/14; F25C 2600/04; H04L 2012/285
See application file for complete search history.

(56) References Cited

U.S. PATENT DOCUMENTS

| | | | | |
|---|---|---|---|---|
| 8,613,203 | B2 | 12/2013 | Kim | |
| 9,618,250 | B2 | 4/2017 | Park | |
| 10,663,205 | B2 | 5/2020 | Brewer et al. | |
| 2010/0308073 | A1* | 12/2010 | Devilbiss | F25D 23/126 62/236 |
| 2022/0155741 | A1 | 5/2022 | Rexach et al. | |
| 2022/0247593 | A1 | 8/2022 | Knatt et al. | |

FOREIGN PATENT DOCUMENTS

| | | | |
|---|---|---|---|
| KR | 200328475 | Y1 | 12/2003 |
| WO | WO2007068506 | A1 | 6/2007 |

* cited by examiner

*Primary Examiner* — Cassey D Bauer
(74) *Attorney, Agent, or Firm* — Dority & Manning, P.A.

(57) ABSTRACT

A method of operating a domestic appliance including a water supply inlet, an ice maker, and a water storage tank fluidly connected with each of the water supply inlet and the ice maker includes receiving information from one or more remote sources relating to a quality of water from a municipal water supply to the water supply inlet; determining a health advisory has been issued regarding a geographical location of the domestic appliance in response to receiving the information; and initiating at least one responsive action within the domestic appliance in response to determining that the health advisory has been issued, the at least one responsive action including adjusting a primary supply source of water to the ice maker from the water supply inlet to the water storage tank.

20 Claims, 6 Drawing Sheets

METHODS FOR OPERATING DOMESTIC APPLIANCES INCLUDING MUNICIPAL WATER SUPPLIES

FIELD OF THE INVENTION

The present subject matter relates generally to domestic appliances, and more particularly to methods for conditionally operating domestic appliances according to third party information.

BACKGROUND OF THE INVENTION

Refrigerator appliances generally include one or more cabinets defining chambers for the receipt of food items for storage. Refrigerator appliances may also include features for dispensing ice and/or liquid water. To provide ice and/or liquid water, a dispenser is typically positioned on a door of the appliance. The user positions a container proximate the dispenser, and ice and/or liquid water are deposited into the container depending upon the user's selection. A paddle or other type switch may be provided whereby the user may make a selection. Typically, the liquid water is supplied from a municipal water connection such as a city or local water supply.

Many areas experience issues which may result in contamination to the water supply. For instance, broken water main pipes, industrial accidents, construction, or other activities may lead to health safety advisory actions being issued. Typically, these actions require any incoming water to be properly treated before being consumed to avoid potential illnesses. However, some users of these appliances may be unaware of a majority of advisories issued, which may result in unintended consumption of contaminated water. Current systems may alert users to potential advisories, however further improvements are necessary to effectively enact procedures in the event of an advisory.

Accordingly, a domestic appliance which obviates one or more of the above-mentioned drawbacks would be beneficial. In particular, a method of operating a domestic appliance which initiates one or more determined actions in the event of certain advisories would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a domestic appliance is provided. The domestic appliance may include a water supply inlet, an icemaker, and a water storage tank fluidly connected with each of the water supply inlet and the icemaker. The method may include receiving information from one or more remote sources relating to a quality of water from a municipal water supply to the water supply inlet; determining a health advisory has been issued regarding a geographical location of the domestic appliance in response to receiving the information; and initiating at least one responsive action within the domestic appliance in response to determining that the health advisory has been issued, the at least one responsive action including adjusting a primary supply source of water to the icemaker from the water supply inlet to the water storage tank.

In another exemplary aspect of the present disclosure, a domestic appliance is provided. The domestic appliance may include a cabinet forming a receiving space; a water supply inlet provided on the cabinet and through which water is supplied to the receiving space from a municipal water supply; a water storage tank fluidly coupled with the water supply inlet; an icemaker provided in the cabinet, the icemaker being fluidly connected with each of the water supply inlet and the water storage tank; and one or more controllers operably connected with the water supply inlet, the water storage tank, and the icemaker, the one or more controllers comprising a wireless communication module to allow for a remote connection, the one or more controllers configured to perform an operation. The operation may include receiving information from one or more remote sources relating to a quality of water from the municipal water supply to the water supply inlet; determining a health advisory has been issued regarding a geographical location of the domestic appliance in response to receiving the information; and initiating at least one responsive action within the domestic appliance in response to determining that the health advisory has been issued, the at least one responsive action including adjusting a primary supply source of water to the icemaker from the water supply inlet to the water storage tank.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
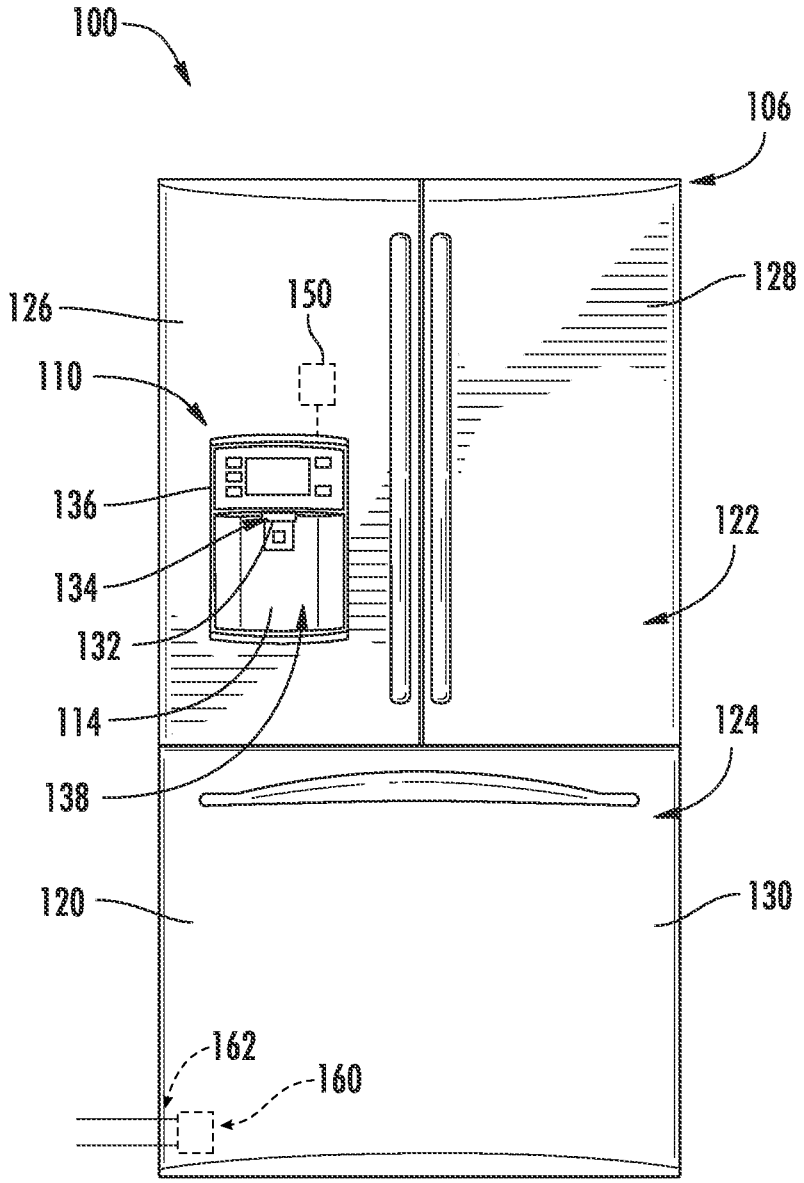
FIG. 1 provides a front, elevation view of a refrigerator appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to the figures, FIG. 1 depicts a front view of an example embodiment of a refrigerator appliance 100. Refrigerator appliance 100 includes a cabinet or housing 120 defining an upper fresh food chamber 122 and a lower freezer chamber 124 arranged below the fresh food chamber 122. As such, refrigerator appliance 100 is generally referred to as a bottom-mount refrigerator appliance. In the exemplary embodiment, housing 120 also defines a mechanical compartment (not shown) for receipt of a sealed cooling system. Using the teachings disclosed herein, one of skill in the art will understand that the present invention may be used with other types of refrigerator appliances (e.g., side-by-sides or top-mounts). Consequently, the description set forth herein is for illustrative purposes only and is not intended to limit the invention to any particular style of refrigerator appliance or arrangement of chilled chambers.

Refrigerator doors 126, 128 are rotatably hinged to an edge of housing 120 for accessing fresh food compartment 122. A freezer door 130 is arranged below refrigerator doors 126, 128 for accessing freezer chamber 124. In the exemplary embodiment, freezer door 130 is coupled to a freezer drawer (not shown) slidably mounted within freezer chamber 124.

Refrigerator appliance 100 includes a dispensing assembly 110 for dispensing liquid water and ice. Dispensing assembly 110 includes a dispenser 114 positioned on an exterior portion of refrigerator appliance 100. Dispenser 114 includes a discharging outlet 134 for accessing ice and liquid water. Dispensing assembly 110 further includes a sensor 112 positioned on discharging outlet 134. As will be described in more detail below, sensor 112 may be configured to detect a presence of a container positioned within dispensing assembly 110, and to detect the top lip of the container. A user interface panel 136 is provided for controlling the mode of operation. For example, user interface panel 136 includes a water dispensing button (not labeled) and an ice-dispensing button (not labeled) for selecting a desired mode of operation such as crushed, non-crushed ice, or liquid water, etc.

Discharging outlet 134 is an external part of dispenser 114, and is mounted in a dispensing recess or recessed portion 138 defined in an outside surface of refrigerator door 126. Recessed portion 138 is positioned at a predetermined elevation convenient for a user to access ice or liquid water and enabling the user to access ice or liquid water without the need to bend-over and without the need to access freezer chamber 124. In the exemplary embodiment, recessed portion 138 is positioned at a level that approximates the chest level of a user.

Refrigerator appliance 100 may include a valve 160. Valve 160 may selectively allow a flow of water (e.g., from a municipal water supply) into refrigerator appliance 100. Thus, valve 160 may be provided on a water supply inlet 162 of refrigerator appliance 100. Valve 160 may be an electromechanical valve, for instance. However, it should be understood that the valve may be any suitable valve, such as a mechanical valve (with an attached servo motor), a solenoid valve, a motor valve, or the like. Valve 160 may selectively open or close according to a signal input from a controller (described below).

Figure 2:
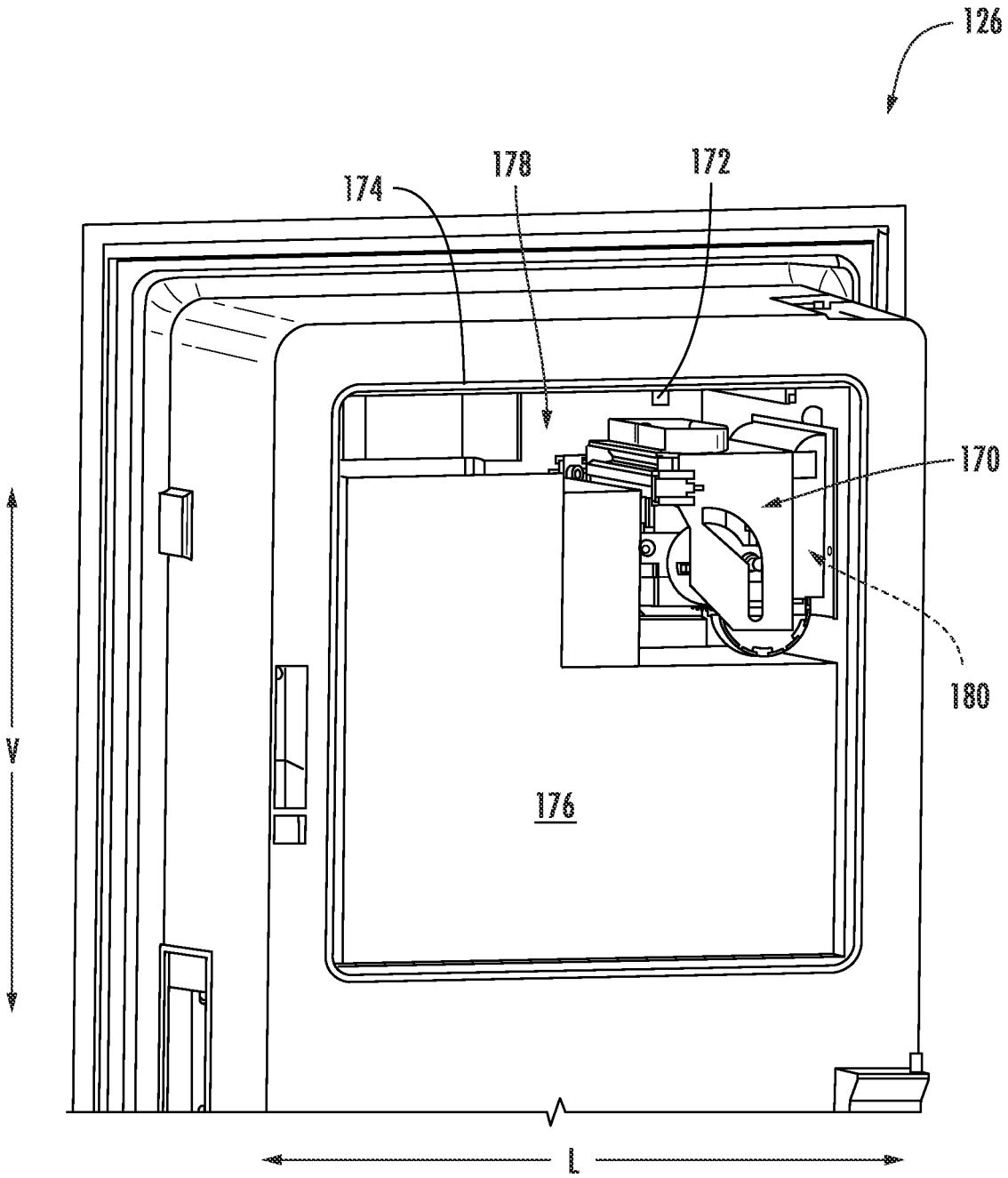
FIG. 2 provides a perspective view of an interior of a door of the exemplary refrigerator appliance of FIG. 1 showing an ice maker.

Referring now to FIG. 2, an ice making assembly 170 may be provided within refrigerator appliance 100. As illustrated, ice making assembly 170 may be mounted on an icebox 174 within an ice making chamber 178 and is configured for receiving a flow of water from water supply input or spout 172. Ice making assembly 170 may include an icemaker 180. In this manner, icemaker 180 may be generally configured for freezing the water to form ice cubes which may be stored in a storage bin 176 and dispensed through discharging outlet 146 by dispensing assembly 110. However, it should be appreciated that ice making assembly 170 is described herein only for the purpose of explaining aspects of the present subject matter. Variations and modifications may be made to ice making assembly 170 while remaining within the scope of the present subject matter. For example, ice making assembly 170 could instead be positioned within freezer chamber 124 of refrigerator appliance 100 and may have any other suitable configuration.

Refrigerator appliance 100 further includes a controller 150. Operation of the refrigerator appliance 100 is regulated by controller 150 that is operatively coupled to user input panel 136. In one exemplary embodiment, user input panel 136 may represent a general purpose I/O ("GPIO") device or functional block. In another exemplary embodiment, user input panel 136 may include input components, such as one or more of a variety of electrical, mechanical or electromechanical input devices including rotary dials, push buttons, and touch pads. User input panel 136 may be in communication with controller 150 via one or more signal lines or shared communication busses.

User input panel (or user input) 136 provides selections for user manipulation of the operation of refrigerator appliance 100. In response to user manipulation of the user input panel 136, controller 150 operates various components of refrigerator appliance 100. For example, controller 150 is operatively coupled or in communication with actuator 132, first ultrasonic sensor 152, and second ultrasonic sensor 154, such that controller 150 can operate such components. In particular, controller 150 is in communication with first and second ultrasonic sensors 152 and 154 and may receive signals from such components. Controller 150 can receive such signals in order to detect or locate a container within dispenser recess 138 as discussed above.

Controller 150 includes memory and one or more processing devices such as microprocessors, CPUs or the like, such as general or special purpose microprocessors operable to execute programming instructions or micro-control code associated with operation of refrigerator appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 3:
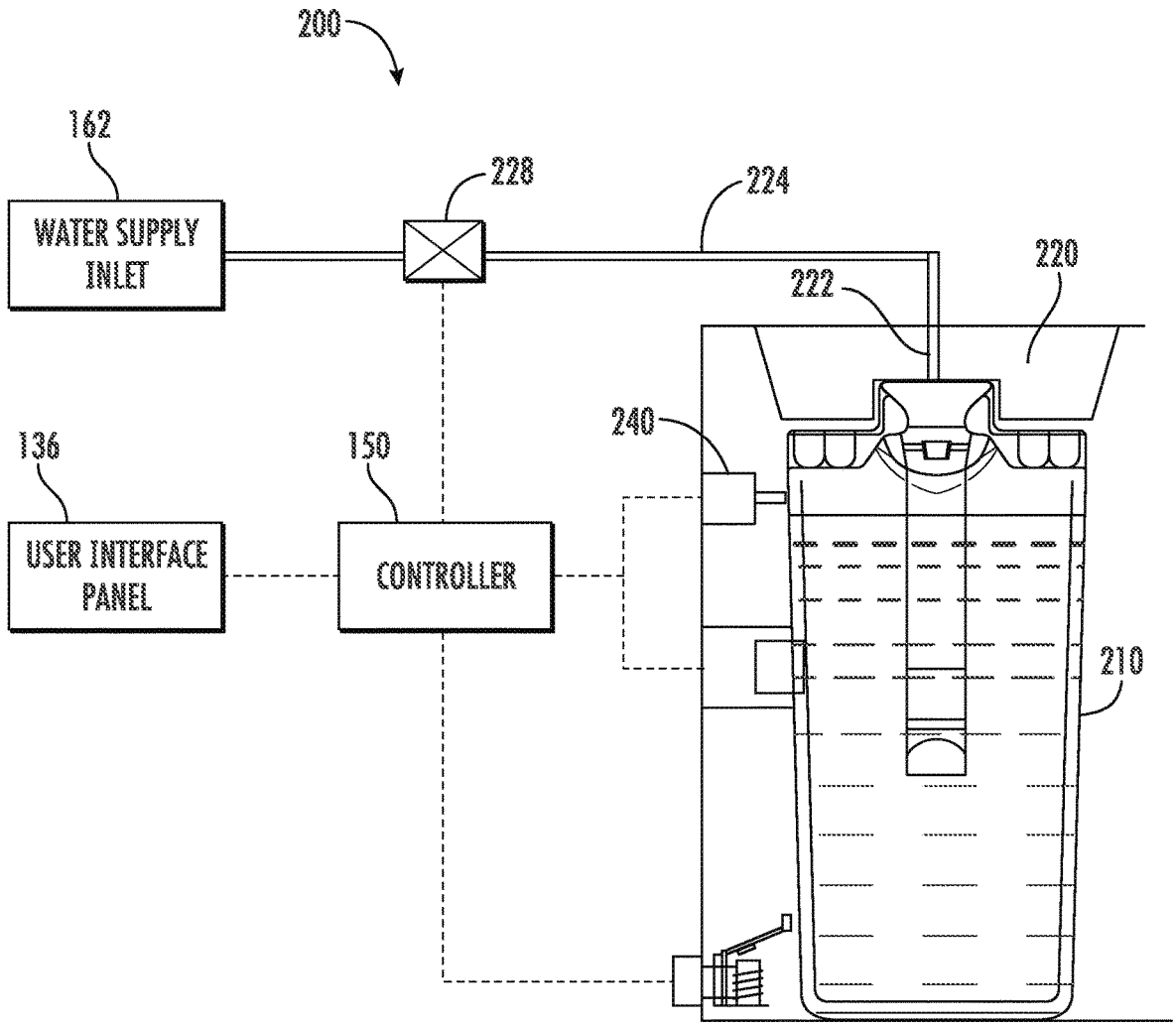
FIG. 3 provides a schematic view of an exemplary dispensing system according to an example embodiment of the present subject matter.

FIG. 3 provides a schematic view of a dispensing system 200 according to an example embodiment of the present subject matter. For this embodiment, dispensing system 200 is generally positioned within a chilled chamber, e.g., fresh food chamber of refrigerator appliance 100 of FIG. 1. As noted above, generally, dispensing system 200 includes features for dispensing liquid into a water storage tank 210 (e.g., an autofill pitcher) positioned or present in a preselected position. As shown, water storage tank 210 may be positioned within the chilled chamber. However, it should be understood that water storage tank 210 is provided by way of example only, and that any suitable water storage tank 210 may be incorporated, including a remote water storage tank (e.g., connected through a series of conduits).

Further, in accordance with example aspects of the present disclosure, dispensing system 200 may include features for sensing the liquid level within water storage tank 210 before, during, or after filling water storage tank 210 with liquid by measuring characteristics (e.g., displacement amplitude, time decay of the displacement amplitude over a predetermined period, etc.) of vibrations propagated through water storage tank 210. The characteristics can be correlated to a precise volume of liquid contained within water storage tank 210, and thus, the liquid level can be determined with high accuracy. However, it should be understood that the exemplary features for sensing the liquid level within water storage tank 210 are provided by way of example only, and any suitable means, features, or methods for determining a liquid level, volume, or amount of water within water storage tank 210 may be incorporated.

Dispensing system 200 may include various features for delivering or flowing liquid to water storage tank 210 when water storage tank 210 is present in the preselected position as shown in FIG. 3. Particularly, dispensing system 200 may include a spout 222 for dispensing liquid into water storage tank 210 present in the preselected position. For instance, water may flow through spout 222 and into water storage tank 210, e.g., to fill water storage tank 210 to a desired predetermined liquid level. Spout 222 may be positioned within dispenser housing 220 in the depicted embodiment of FIG. 3, but in alternative embodiments, spout 222 need not be positioned within dispenser housing 220. Dispensing system 200 may also include a supply conduit 224 fluidly connecting water supply inlet 162 with spout 222. As discussed above, water supply inlet 162 may be a municipal water line, a filtered water source, or some other suitable supply of liquid.

A valve 228 may be positioned along supply conduit 224 and may be movable between an open position and a closed position. Valve 228 may be operable to selectively allow liquid to flow from liquid supply 226 to spout 222. Valve 228 may be a multi-way valve. For instance, referring briefly to FIG. 4, valve 228 may be a three-way valve, or T-valve. Accordingly, valve 228 may include multiple inlets and outlets to allow liquid (e.g., water) to flow in multiple directions, as will be explained further below.

According to some embodiments, when valve 228 is moved to the open position, valve 228 may allow the flow of liquid from water supply inlet 162 to spout 222 and ultimately water storage tank 210. In contrast, when valve 228 is moved to the closed position, valve 228 may prevent or prohibit the flow of liquid from water supply inlet 162 to spout 222, and thus, no liquid flows into water storage tank 210. Valve 228 may be any suitable type of valve. For example, valve 228 may be a solenoid-actuated valve. Additionally or alternatively, valve 228 may be operably connected with controller 150. Accordingly, valve 228 may be operated according to input signals from controller 150.

Dispensing system 200 may also include various features for detecting the presence of water storage tank 210 in the preselected position. For instance, for the depicted embodiment of FIG. 3, dispensing system 200 includes a proximity device 240. Proximity device 240 may be mounted within appliance 100 beneath dispenser housing 220 along the vertical direction V, for example. Proximity device 240 may detect whether water storage tank 210 is present in the preselected position. Controller 150 communicatively coupled with proximity device 240 may receive, from proximity device 240, one or more signals indicating whether water storage tank 210 is present in the preselected position. If water storage tank 210 is present in the preselected position as determined by controller 150 based on the one or more signals, then controller 150 may perform certain operations to fill water storage tank 210 with liquid. If, on the other hand, water storage tank 210 is not present in the preselected position as determined by controller 150 based on the one or more signals, then controller 150 may determine not to commence dispensing liquid or can perform certain operations to cease filling water storage tank 210 with liquid, e.g., in the event water storage tank 210 is removed from the preselected position during a filling cycle or operation. In some embodiments, proximity device 240 may be a proximity switch that can be depressed when water storage tank 210 is present in the preselected position or withdrawn when water storage tank 210 is not present in the preselected position, for example. In yet other embodiments, proximity device 240 can be a magnetoresistance sensor and can be configured to detect a proximity element (e.g., a magnet) disposed within water storage tank 210, e.g., within a lid 212 of container.

Figure 4:
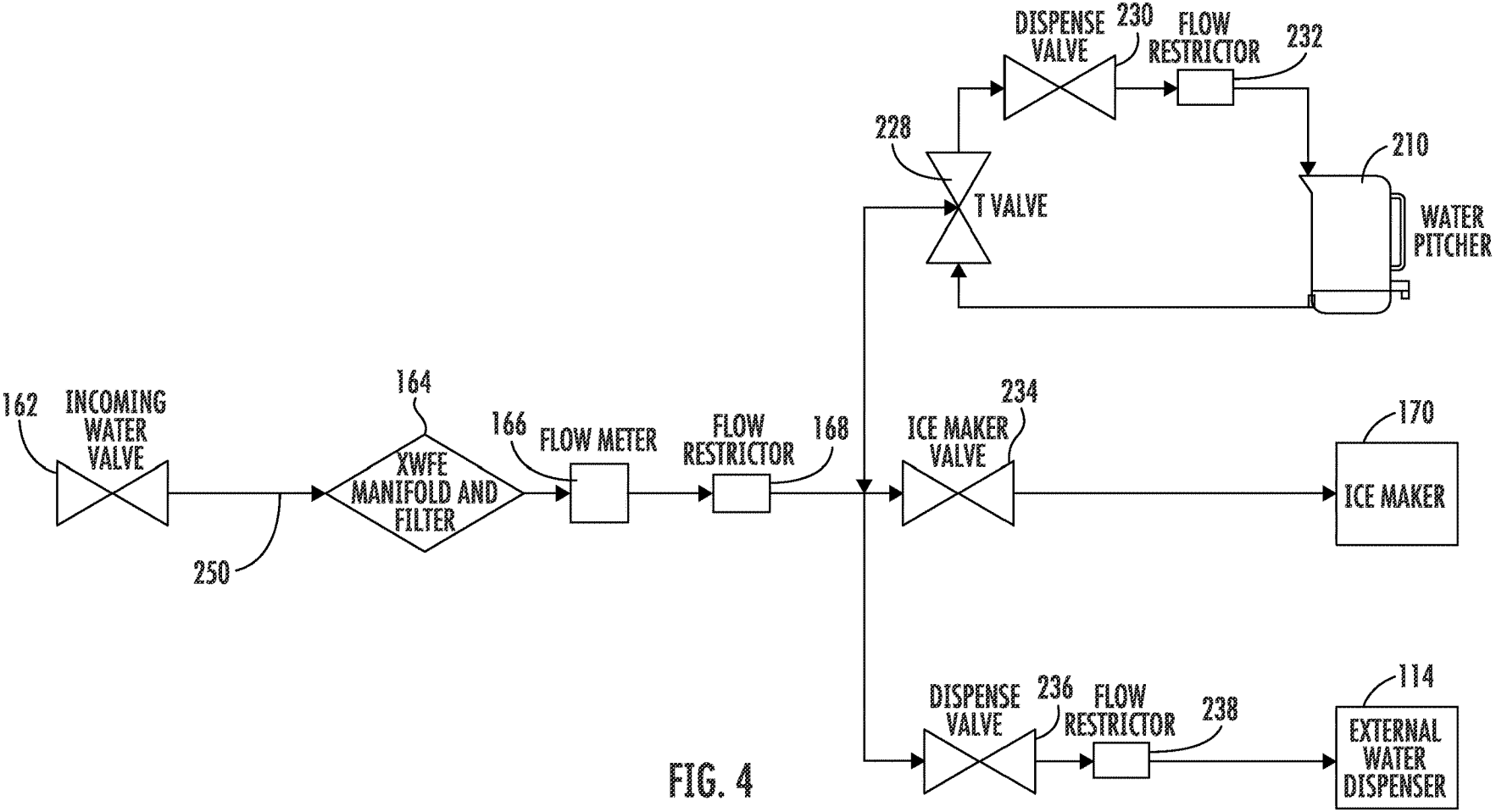
FIG. 4 provides a schematic diagram of a water supply system of the refrigerator appliance of FIG. 1 according to exemplary embodiments of the present disclosure.

FIG. 4 provides a schematic diagram of an exemplary water supply circuit of appliance 100. The water supply circuit may include water supply inlet 162 (e.g., positioned at or near water supply valve 160). As shown in FIG. 4, water may be supplied through appliance 100 via a water supply line 250. Water supply line 250 may thus be fluidly connected with each of water supply inlet 162, water storage container 210 (e.g., via valve 228), ice maker 170, and dispenser 114. According to some embodiments, the water supply circuit includes a filter 164. Filter 164 may selectively filter the water supplied through water supply inlet 162 before the water is provided to one or more of water storage tank 210, ice maker 170, or dispenser 114. Additionally or alternatively, the water supply circuit may include a flow meter 166 to sense or determine an amount or volume of water flowing through the water supply circuit. Further, the water supply circuit may include a flow restrictor 168 to control a flow pressure, speed, or volume of water through the water supply circuit.

Valve 228 may be fluidly connected with water supply line 250. As mentioned above, valve 228 may be a three-way valve. Thus, water supplied into valve 228 may be diverted toward water storage tank 210. Accordingly, a storage valve 230 may be included (e.g., on supply conduit 224). Storage valve 230 may selectively prohibit or permit water to flow into water storage container 210. For instance, storage valve 230 may be operably connected with controller 150. Controller 150 may provide signals to storage valve 230 to open or close according to a request to supply water to water storage container 210. A second flow restrictor 232 may be provided adjacent to storage valve 230. Similar to flow restrictor 168 mentioned above, second flow restrictor 232 may control a pressure, speed, or volume of water through supply conduit 224 (e.g., toward spout 222).

As mentioned briefly above, water storage tank 210 (e.g., such as a pitcher) may be connected to a dock or docking station. According to some embodiments, the docking station includes a pump 240. Pump 240 may be fluidly connected with water storage tank 210 and valve 228. Thus, in some instances, pump 240 may selectively pump liquid (e.g., water) from water storage tank 210 toward valve 228, as will be explained in more detail below.

Ice maker 170 may selectively receive water from water supply line 250. As shown in FIG. 4, the water provided to ice maker 170 may come from either water supply inlet 162 or water storage tank 210. For instance, a primary source of water for ice maker 170 may be switched back and forth between water supply inlet 162 and water storage tank 210. An ice maker valve 234 may be provided along water supply line 250. Ice maker valve 234 may be operably connected with controller 150. Thus, ice maker valve 234 may selectively open and close to selectively provide water to ice maker 170 to be frozen into ice cubes (or shapes).

Dispenser 114 may be provided along water supply line 250. For instance, a dispensing line may branch off of water supply line 250 toward dispenser 114. A dispenser valve 236 may be provided along the dispensing line. Dispenser valve 236 may be operably coupled with controller 150. Thus, according to inputs from controller 150, dispenser valve 236 may selectively open and close to selectively flow water toward dispenser 114. Additionally or alternatively, a third flow restrictor 238 may be provided along the dispensing line. Similar to the flow restrictors mentioned above, third flow restrictor 238 may control a pressure, speed, or volume of water through the dispensing line (e.g., toward dispenser 114).

Figure 5:
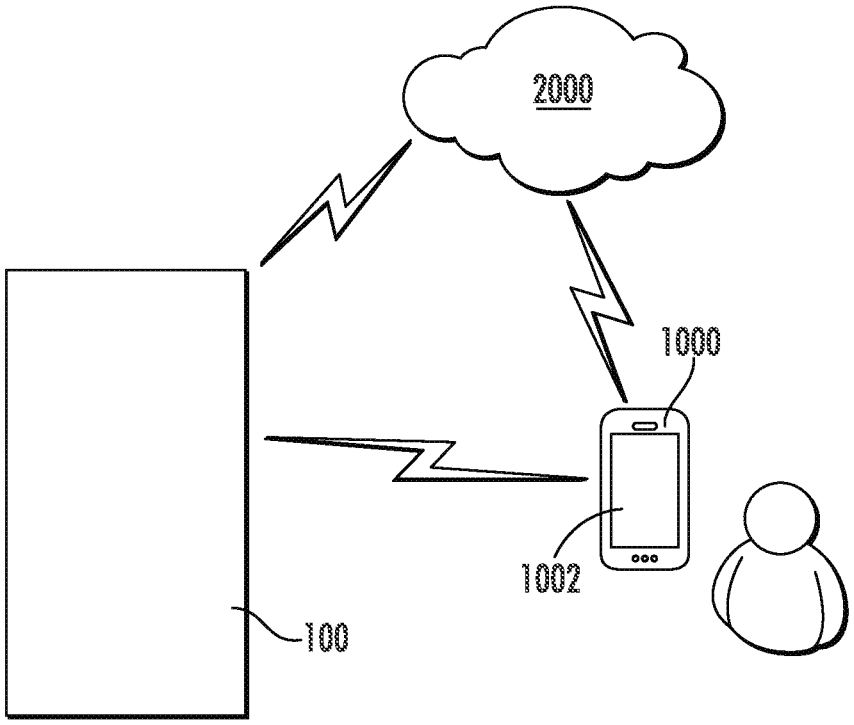
FIG. 5 provides a schematic illustration of an exemplary refrigerator appliance in communication with a remote user interface device according to one or more embodiments of the present disclosure.

FIG. 5 schematically illustrates the refrigerator appliance 100 communicating with a remote user interface device 1000. Also shown (but not numbered) in FIG. 5 is a user such as may interact with the remote user interface device 1000, e.g., via a user interface 1002 of the remote user interface such as a touchscreen in the illustrated embodiment. For example, the remote user interface device 1000 may be a device such as a cell phone, smart phone, smart assistant, or any similar device in operative communication with the controller 150 via a wireless connection. As shown in FIG. 5, the refrigerator appliance 100, and in particular, controller 150 thereof, may be configured to communicate with a separate device external to the appliance 100, such as a communications device or other remote user interface device 1000. The remote user interface device 1000 may be a laptop computer, smartphone, tablet, personal computer, wearable device, smart home system (such as a smart assistant speaker), or various other suitable devices. The refrigerator appliance 100 may include a network communication module, e.g., a wireless communication module, for communicating with the remote user interface device 1000. In various embodiments, a network communication module may include a network interface such that the controller 150 of the refrigerator appliance 100 can connect to and communicate over one or more networks with one or more network nodes. A network communication module may also include one or more transmitting, receiving, or transceiving components for transmitting/receiving communications with other devices communicatively coupled with refrigerator appliance 100. The network communication module may be in communication with, e.g., coupled or connected to, the controller 150 to transmit signals to and receive signals from the controller 150.

As schematically illustrated in FIG. 5, the refrigerator appliance 100 may be configured to communicate with the remote user interface device 1000 either directly or through a network 2000 (e.g., a smart home network). Thus, in various embodiments, the refrigerator appliance 100 and the remote user interface 1000 may be configured to communicate wirelessly with each other or with the network 2000. The network 2000 may be or include various possible communication connections and interfaces, e.g., such as Zigbee, BLUETOOTH®, WI-FI®, or any other suitable communication connection. The remote user interface device 1000 may include a memory for storing and retrieving programming instructions. For example, the remote user interface device 1000 may be a smartphone operable to store and run applications, also known as "apps," and may include a remote user interface provided as a smartphone app. Additionally or alternatively, multiple remote user interface devices 1000 may be connected with refrigerator appliance 100. For instance, one or more smart phones, one or more smart assistant devices (smart speakers), or the like may be simultaneously connected with refrigerator appliance 100 (e.g., through network 2000).

Figure 6:
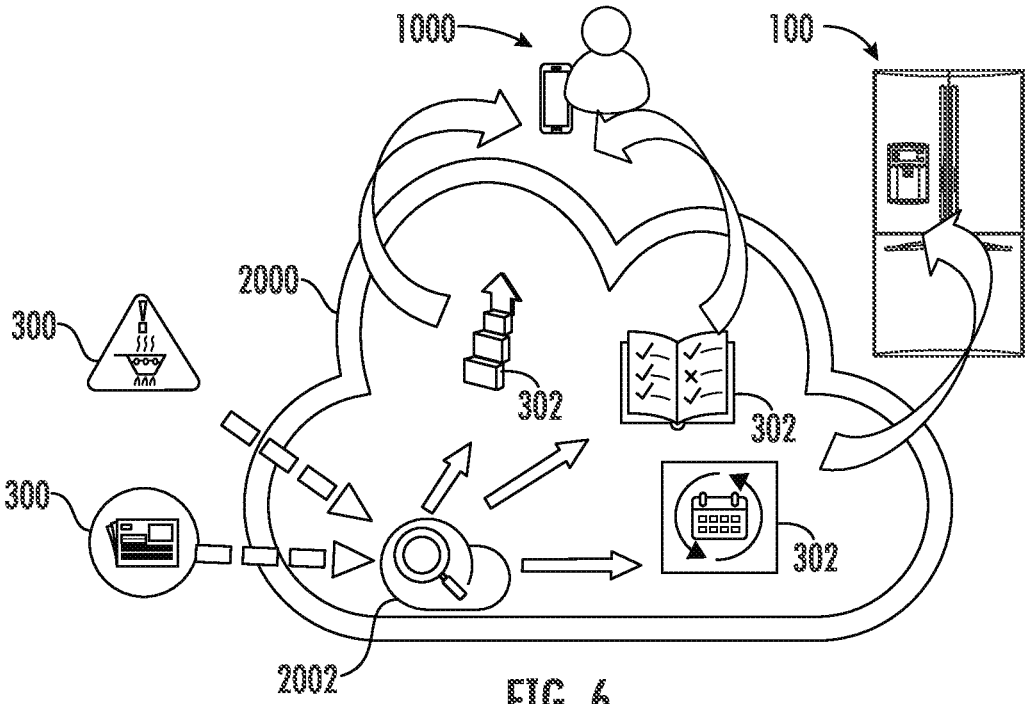
FIG. 6 provides a schematic illustration of an exemplary refrigerator appliance in communication with a remote network according to one or more embodiments of the present disclosure.

FIG. 6 provides a graphical representation of a system 170 including appliance 100 and user interface device 1000. For instance, the system 170 may include network 2000. One or more remote sources 300 (e.g., news sources, social media networks, search engines, etc.) may be connected to network 2000. Thus, information from the one or more remote sources 300 may be selectively provided to appliance 100, user interface device 1000, or additional remote devices. The network may include a remote server 2002. The remote server 2002 may collect, compile, organize, analyze, distribute, etc., the information collected from remote sources 300. Additionally or alternatively, remote server 2002 may develop or otherwise formulate informational data files 302 (e.g., guides, tips, instructions, etc.). The informational data files may be selectively distributed to appliance 100, user interface device 1000, or the like, as will be explained in further detail below.

Figure 7:
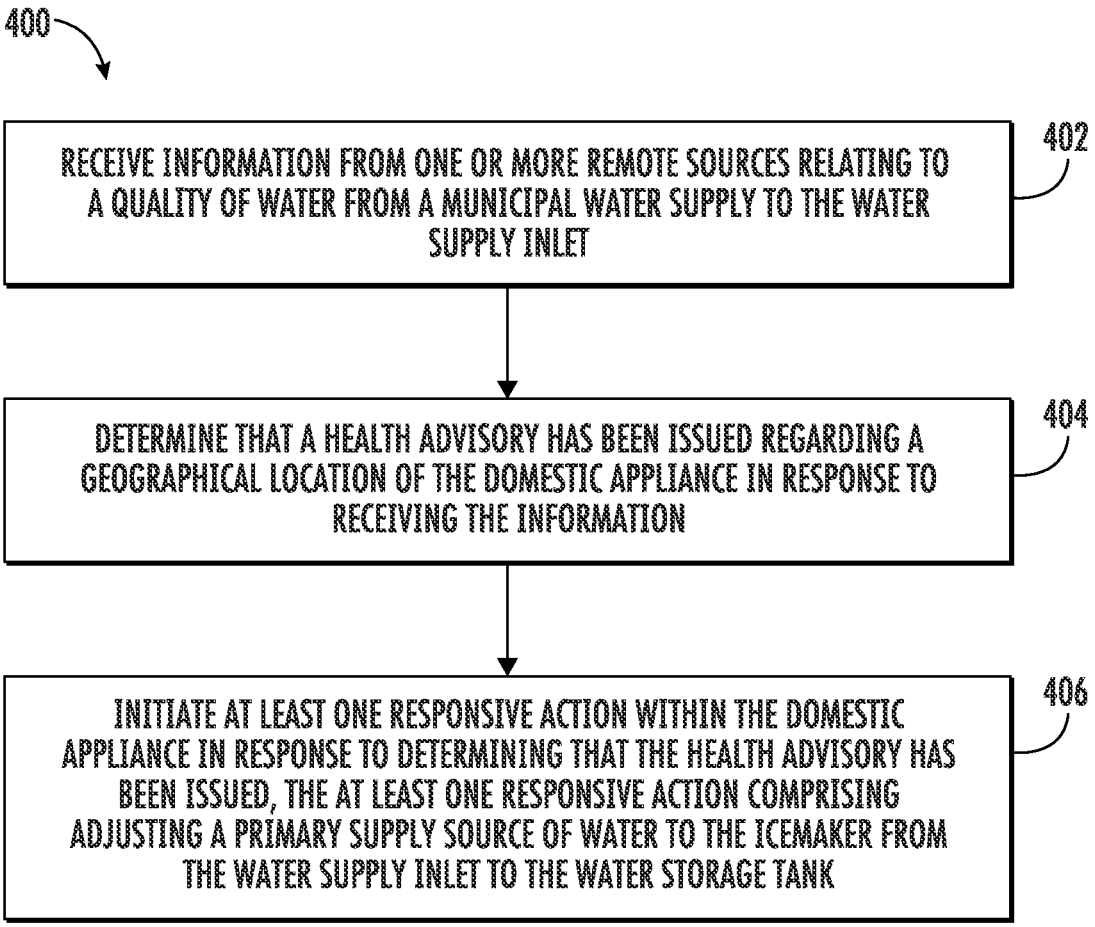
FIG. 7 provides a flow chart illustrating a method of operating a refrigerator appliance.

FIG. 7 depicts a flow diagram of an example method 400 of operating a domestic (e.g., refrigerating) appliance according to a specific embodiment of the present disclosure. The controller 150 of appliance 100 may be configured or programmed to implement method 400. In addition, FIG. 7 depicts steps performed in a particular order for purposes of illustration and discussion. Those of ordinary skill in the art, using the disclosures provided herein, will understand that the steps of any of the methods disclosed herein may be modified, adapted, expanded, omitted, and/or rearranged in various ways without deviating from the scope of the present disclosure. Additionally or alternatively, a separate dedicated controller may be configured to perform method 400. Further still, method 400 may be applied to any suitable domestic appliance configured to supply water (e.g., liquid water, ice, etc.) to one or more users (e.g., a stand-alone ice dispenser, a stand-alone beverage dispenser, a water cooler, etc.).

At step 402, method 400 may include receiving information from one or more remote sources relating to a quality of water from a municipal water supply to the water supply inlet. In detail, the appliance (e.g., refrigerator appliance 100) may, through a wireless connection to a wireless network, receive at least one informational notification regarding a potential or impending water advisory, such as a boil water advisory. The remote sources may include local or regional news channels or outlets, utilities agencies, health boards, social media networks (e.g., Twitter®, Facebook®, etc.), community message boards, or the like. For instance, the controller of the appliance may periodically scan the one or more remote sources for information relating to water quality issues. Additionally or alternatively, the appliance may include one or more algorithms configured to retrieve or import water-quality specific alerts from the one or more sources.

The one or more remote sources may include a separate remotely connected appliance. For instance, a plurality of appliances may be interconnected via a cloud or wireless network, for example through a remote server. The plurality of appliances may be provided remotely to each other (e.g., in different households or physical locations). Additionally or alternatively, each of the plurality of appliances may belong to or be registered to different unique users. Accordingly, a first remote appliance may receive an input regarding a water quality issue directly from a user. For example, a first user associated with the first remote appliance independently discovers the water quality issue and inputs the discovered information to the first remote appliance. The first remote appliance may then upload the water quality issue to the remotely connected server or cloud. The remotely connected server or cloud may then distribute or communicate the water quality issue to a second remote appliance.

At step 404, method 400 may include determining a health advisory has been issued regarding a geographical location of the domestic appliance in response to receiving the information. In detail, the appliance may analyze the information (e.g., via the one or more controllers). The appliance may then determine that a particular health advisory has been issued. For instance, the appliance determines that a boil water advisory has been instituted or scheduled within a predetermined time. The appliance may determine that the health advisory will affect a geographical location in which the appliance is located.

In detail, the appliance may include location data for itself and the health advisory. The location data of the appliance itself may be procured via an onboard global positioning system (GPS) device. The location data of the health advisory may be gleaned from an analysis of the information received at step 402. For instance, the information may include one or more of a city, a county, a zip code, an area code, a neighborhood, a water supply network, or the like in which the health advisory is to take effect. The appliance may then overlap its own geographical location with the information received to determine if the water supplied thereto will be affected.

At step 406, method 400 may include initiating at least one responsive action within the domestic appliance in response to determining that the health advisory has been issued. The at least one responsive action may include adjusting a primary supply source of water to the ice maker from the water supply inlet to the water storage tank. As mentioned above, the ice maker may be fluidly connected with each of a water input source and a water storage tank (e.g., such as a pitcher provided within the appliance). During a normal operation of the appliance (e.g., refrigerator appliance, beverage dispenser, ice machine, etc.), the primary supply of water to the ice maker may be a municipal or external water supply. Thus, external water from a municipal source may be selectively supplied to the ice maker according to demand, a schedule, or the like.

Upon determining that the health advisory has been issued, method 400 may adjust the primary supply of water to the ice maker. For instance, a normal operating procedure of the appliance may utilize the water supply inlet as the primary source of water to the ice maker. Accordingly, external water, such as a municipal source of water, may be routinely provided to the ice maker during the normal operating procedure. The health advisory may include a water advisory, such as a notification that the municipal supply of water is tainted (e.g., a boil water advisory or BWA). Thus, the water supplied to the ice maker may be changed from the water supply inlet to the water storage tank (e.g., such as a filtered pitcher within the appliance).

According to some embodiments, adjusting the primary supply source of water to the ice maker may include closing a water inlet valve provided at the water supply inlet. As mentioned above, the water inlet valve may be provided to selectively permit or restrict external water from entering the appliance (e.g., into the water supply line). Referring briefly to FIG. 4, after the water inlet valve is closed, external water is restricted from flowing towards the ice maker, the water storage tank, and the dispenser.

Moreover, adjusting the primary supply source of water to the ice maker may include adjusting a multi-way valve (e.g., multi-way valve 228) such that the ice maker receives water from the water storage tank. As mentioned above, the multi-way valve may allow water to flow into the water storage tank (e.g., from the water supply inlet) and may allow water to flow out of the water storage tank (e.g., towards the ice maker or the dispenser). Thus, water stored within the water storage tank may be selectively pumped into or toward the ice maker (e.g., according to a demand, a usage pattern, a schedule, or the like).

The at least one responsive action may include adjusting the ice making pattern of the ice maker. For instance, at step 406, method 400 may include determining an ice usage pattern of the ice maker. The determined ice usage pattern of the ice maker may be based on a time of day, a day of the week, a month of the year, or a combination of two or more of the above-mentioned times. For example, an ice usage pattern of a particular user may be greater at or around an evening time, for instance when making drinks.

Subsequently, method 400 may include determining a volume of water within the water storage tank. For instance, as mentioned above, the appliance may include one or more means of determining a volume of water stored within the water storage tank (e.g., an on board level sensor, a flow meter, a weight sensor, etc.). The volume of water within the water storage tank may be determined after determining that the health advisory has been issued. In some instances, the volume of water within the water storage tank is continually monitored (e.g., as water is supplied to or withdrawn from the water storage tank).

Upon determining the volume of water within the water storage tank, method 400 may analyze or determine a level of ice within an ice storage container of the ice maker. For instance, method 400 may analyze a volume or amount of water that would be required to produce a predetermined amount of ice within the ice maker. The predetermined amount of ice may be associated with the ice usage pattern. For one example, during a time designated as a high usage pattern, the predetermined amount of ice may be a full container or greater than about 50% full container worth of ice. Accordingly, method 400 may determine whether or not the volume of water within the water storage tank is sufficient to form, create, freeze, or otherwise make the predetermined amount of ice.

In the event that the volume of water within the water storage tank is less than an amount required to make the predetermined amount of ice, method 400 may then adjust the ice making pattern of the ice maker. In some instances, method 400 may determine that the volume of water within the water storage tank is below a predetermined low level limit. The predetermined low level limit may be based on the determined ice usage pattern. Method 400 may then reduce the ice making pattern of the ice maker. Accordingly, less water stored within the water storage tank may be used for making ice and may be conserved for consumption by one or more users.

Method 400 may include emitting a notification upon determining that the volume of water within the water storage tank is below the predetermined low level limit. The notification may include the remaining volume of water within the water storage tank (e.g., in a volumetric measurement such as liters, milliliters, gallons, ounces, etc.). In detail, method 400 may include instructing a notification to be sent to a mobile device (e.g., a mobile phone, smart phone, tablet, personal computer, etc.). The notification may be sent from the appliance itself to the mobile device via a network connection. Additionally or alternatively, the notification may be sent from a remote server or cloud.

The notification may be a push notification transmitted to the mobile device. For instance, the notification may appear as an alert on a user's mobile device (e.g., as a pop-up notification on a smart phone). According to some embodiments, the notification is provided to the mobile device via a mobile application (app) installed on the mobile device. The first notification may be a text or graphic notification. For instance, a textual notification may be presented including the alert of the health safety advisory, the volume of water within the water storage tank, a list of potential responsive actions, an affected area, an estimated length of time of the health safety advisory, an amount of ice within the ice storage container, or the like. Additionally or alternatively, a graphical representation of the health safety advisory may be included in the notification. For example, a map of the affected area, pictures or graphic representations of appliances, or the like are included in the notification. A combination of text and graphics may be included in the notification.

In some embodiments, method 400 includes determining an effective implementation time of the health advisory after adjusting the primary source of water to the ice maker. According to one example, method 400 determines that the effective implementation time of the health advisory is 4:00 PM. Method 400 may then determine (e.g., retrieve, calculate, recall, etc.) the last ice production operation performed by the ice maker. Continuing with the example above, method 400 may then determine that the ice maker produced ice within a predetermined time period around the implementation of the health advisory. The predetermined time period may be within 10 minutes before the implementation, within 20 minutes before the implementation, etc.

Method 400 may further determine that the ice maker produced ice any time after the implementation of the health advisory. Additionally or alternatively, method 400 may determine that the ice maker produced ice within a predetermined amount of time before the implementation of the health advisory (e.g., within 20 minutes before the implementation of the health advisory, within 10 minutes before the implementation of the health advisory, etc.). For instance, method 400 may determine that water from the water supply inlet was used to form ice within the ice maker at or around the implementation time of the health advisory.

After determining that the ice maker produced ice at or around the effective implementation time of the health advisory, method 400 may emit an alert. The alert may include a recommendation or instruction to empty (or not use) the ice storage container of the ice maker. For instance, the alert may instruct any user not to use the ice formed at or around the implantation of the health advisory. Similar to the notification described above, the alert may be a push notification transmitted to the mobile device. For instance, the notification may appear as an alert on a user's mobile device (e.g., as a pop-up notification on a smart phone). According to some embodiments, the notification is provided to the mobile device via a mobile application (app) installed on the mobile device. The first notification may be a text or graphic notification.

According to some embodiments, method 400 may include determining that the health advisory has been removed from the geographical location of the domestic appliance. In detail, the appliance may receive additional information from the one or more remote sources indicating that the health safety advisory is no longer in effect. The additional information may indicate that the health safety advisory has particularly been lifted from the geographical location of the appliance. Additionally or alternatively, the appliance may determine that the health safety advisory has been lifted from the initial information (e.g., if a scheduled or predicted end time of the advisory was included in the initial alert).

Accordingly, method 400 may include initiating a post-advisory action in response to determining that the health safety advisory has been lifted or removed. In detail, the post-advisory action may include performing additional responsive actions. The additional responsive actions may include undoing the previously performed responsive actions. For instance, if one of the responsive actions included switching the primary supply of water to the ice maker from the water supply inlet to the water storage tank, the post-advisory action includes switching the primary supply of water to the ice maker back to the water supply inlet from the water storage tank. Similarly, if one of the responsive actions included adjusting the ice making pattern of the ice maker, the post-advisory action includes resetting the ice making pattern of the ice maker to an initial or normal pattern. Accordingly, the post-advisory action may effectively reset the appliance to previous operational settings (e.g., before the health safety advisory).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a domestic appliance, the domestic appliance comprising a water supply inlet, an icemaker, and a water storage tank fluidly connected with each of the water supply inlet and the icemaker, the method comprising:

receiving information from one or more remote sources relating to a quality of water from a municipal water supply to the water supply inlet;

determining a health advisory has been issued regarding a geographical location of the domestic appliance in response to receiving the information; and initiating at least one responsive action within the domestic appliance in response to determining that the health advisory has been issued, the at least one responsive action comprising adjusting a primary supply source of water to the icemaker from the water supply inlet to the water storage tank.

2. The method of claim 1, wherein the domestic appliance further comprises:

a water inlet valve provided at the water supply inlet; and a multi-way valve connected between the water supply inlet, the icemaker, and the water storage tank.

3. The method of claim 2, wherein adjusting the primary supply source of water to the icemaker comprises:

closing the water inlet valve; and adjusting the multi-way valve such that the icemaker receives water from the water storage tank.

4. The method of claim 1, wherein the at least one responsive action further comprises adjusting an ice making pattern of the icemaker.

5. The method of claim 4, further comprising:

determining an ice usage pattern of the icemaker; and determining a volume of water within the water storage tank, wherein adjusting the ice making pattern is based on the determined ice usage pattern and the volume of water within the water storage tank.

6. The method of claim 5, further comprising:

determining that the volume of water within the water storage tank is below a predetermined low level limit; and emitting a notification comprising a remaining volume of water within the water storage tank.

7. The method of claim 6, wherein the notification is a text or graphic notification transmitted to a personal remote device.

8. The method of claim 1, wherein the water storage tank is a water pitcher positioned within a storage chamber of the domestic appliance.

9. The method of claim 1, further comprising:

determining an effective implementation time of the health advisory after adjusting the primary supply source of water to the icemaker;

determining that the icemaker produced ice after the effective implementation time; and emitting an alert to empty an ice storage container of the icemaker.

10. The method of claim 1, further comprising:

determining that the health advisory has been removed from the geographical location of the domestic appliance; and initiating a post-advisory action in response to determining that the health advisory has been removed, the post-advisory action comprising adjusting the primary supply source of water to the icemaker from the water storage tank to the water supply inlet.

11. A domestic appliance comprising:

a cabinet forming a receiving space;

a water supply inlet provided on the cabinet and through which water is supplied to the receiving space from a municipal water supply;

a water storage tank fluidly coupled with the water supply inlet;

an icemaker provided in the cabinet, the icemaker being fluidly connected with each of the water supply inlet and the water storage tank; and one or more controllers operably connected with the water supply inlet, the water storage tank, and the icemaker, the one or more controllers comprising a wireless communication module to allow for a remote connection, the one or more controllers configured to perform an operation, the operation comprising:

receiving information from one or more remote sources relating to a quality of water from the municipal water supply to the water supply inlet;

determining a health advisory has been issued regarding a geographical location of the domestic appliance in response to receiving the information; and initiating at least one responsive action within the domestic appliance in response to determining that the health advisory has been issued, the at least one responsive action comprising adjusting a primary supply source of water to the icemaker from the water supply inlet to the water storage tank.

12. The domestic appliance of claim 11, further comprising:

a water inlet valve provided at the water supply inlet; and a multi-way valve connected between the water supply inlet, the icemaker, and the water storage tank.

13. The domestic appliance of claim 12, wherein adjusting the primary supply source of water to the icemaker comprises:

closing the water inlet valve; and adjusting the multi-way valve such that the icemaker receives water from the water storage tank.

14. The domestic appliance of claim 11, wherein the at least one responsive action further comprises adjusting an ice making pattern of the icemaker.

15. The domestic appliance of claim 14, wherein the operation further comprises:

determining an ice usage pattern of the icemaker; and determining a volume of water within the water storage tank, wherein adjusting the ice making pattern is based on the determined ice usage pattern and the volume of water within the water storage tank.

16. The domestic appliance of claim 15, wherein the operation further comprises:

determining that the volume of water within the water storage tank is below a predetermined low level limit; and emitting a notification comprising a remaining volume of water within the water storage tank.

17. The domestic appliance of claim 16, wherein the notification is a text or graphic notification transmitted to a personal remote device.

18. The domestic appliance of claim 11, wherein the water storage tank is a water pitcher positioned within a storage chamber of the domestic appliance.

19. The domestic appliance of claim 11, wherein the operation further comprises:

determining an effective implementation time of the health advisory after adjusting the primary supply source of water to the icemaker;

determining that the icemaker produced ice after the effective implementation time; and emitting an alert to empty an ice storage container of the icemaker.

20. The domestic appliance of claim 11, wherein the operation further comprises:

determining that the health advisory has been removed from the geographical location of the domestic appliance; and initiating a post-advisory action in response to determining that the health advisory has been removed, the post-advisory action comprising adjusting the primary supply source of water to the icemaker from the water storage tank to the water supply inlet.

* * * * *